US012722877B2

(12) United States Patent
Knezevik et al.

(10) Patent No.: US 12,722,877 B2
(45) Date of Patent: Sep. 1, 2026

(54) COLLAPSIBLE, REUSABLE BULK SOLID CONTAINER

(71) Applicant: Halliburton Energy Services, Inc., Houston, TX (US)

(72) Inventors: Nebojsa Knezevik, Fort Lupton, CO (US); Ernst Rudolf Man Schnell, Houston, TX (US); Elizabeth Wells, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 171 days.

(21) Appl. No.: 18/347,347

(22) Filed: Jul. 5, 2023

(65) Prior Publication Data

US 2025/0011074 A1 Jan. 9, 2025

(51) Int. Cl.
*B65D 90/20* (2006.01)
*B65D 88/74* (2006.01)

(52) U.S. Cl.
CPC ..... *B65D 88/741* (2013.01); *B65D 2588/165* (2013.01)

(58) Field of Classification Search
CPC ..... B65D 88/741; B65D 2588/165; B65D 88/20; B65D 90/20; B65D 90/205; B65D 88/16; B65D 88/1606; B65D 88/1612; B65D 88/1618; B65D 88/1625; B65D 88/1631; B65D 88/1637; B65D 88/1643; B65D 88/165; B65D 88/1656; B65D 88/1662; B65D 88/1668; B65D 88/1675; B65D 88/1681; B65D 88/1687;
(Continued)

(56) References Cited

U.S. PATENT DOCUMENTS 4,036,361 A * 7/1977 Jacobson ..... B65D 88/20 220/6
4,946,214 A * 8/1990 Neumann ..... B65D 88/522 410/58

(Continued)

FOREIGN PATENT DOCUMENTS

BR PI0803848 A2 6/2010
CN 1863706 A 11/2008

(Continued)

OTHER PUBLICATIONS

Machine translation of CN-114394289-A. (Year: 2022).*

(Continued)

*Primary Examiner* — Nathan J Newhouse
*Assistant Examiner* — Nina K Attel
(74) *Attorney, Agent, or Firm* — Sheri Higgins Law, PLLC; Sheri Higgins

(57) ABSTRACT

A bulk solids container can include a bag to hold the bulk solid, a rigid base to support the bag, and rods extending up from the base to the top of the bag. The rods provide vertical structural integrity to the sides of the bag. The base can include a sloped upper surface sloping down towards a discharge opening located near the center of the base and aeration openings that inhibit or prevent the bulk solids from clogging the discharge opening during removal of the bulk solids from the bag. When the bag is empty, the bag and the rods can be collapsed and fit on top of the upper surface of the base. The container can be transported back to a fill facility to be reused.

20 Claims, 7 Drawing Sheets

(58) Field of Classification Search
CPC .... B65D 88/1693; B65D 88/18; B65D 88/22; B65D 88/24
USPC ..... 383/121.1; 220/9.1–9.3; 248/95, 97
See application file for complete search history.

(56) References Cited

U.S. PATENT DOCUMENTS

| | | | | | |
|---|---|---|---|---|---|
| 5,437,384 | A * | 8/1995 | Farrell | B65D 19/12 220/9.4 |
| 5,622,277 | A * | 4/1997 | Van Giezen | B65D 77/061 220/9.4 |
| 5,722,552 | A | 3/1998 | Olson | |
| 5,897,012 | A | 4/1999 | Sortwell | |
| 8,919,589 | B2 * | 12/2014 | Hill | B65D 77/061 220/9.3 |
| 9,296,511 | B2 * | 3/2016 | Jones | B65D 11/1866 |
| 10,399,741 | B2 * | 9/2019 | De Villiers | B65D 19/385 |
| 2004/0074922 | A1 | 4/2004 | Bothor | |
| 2007/0131303 | A1 | 6/2007 | Strub et al. | |
| 2015/0368039 | A1 * | 12/2015 | Cochrum | B65D 88/66 406/75 |
| 2016/0264292 | A1 | 9/2016 | Schoening | |
| 2021/0284435 | A1 | 9/2021 | Kresse et al. | |

FOREIGN PATENT DOCUMENTS

| | | | | |
|---|---|---|---|---|
| CN | 114394289 | A * | 4/2022 | B65B 43/54 |
| DE | 19915703 | A1 | 10/2000 | |
| DE | 10025595 | A1 | 8/2003 | |
| DE | 20315912 | U1 | 12/2003 | |
| DE | 102007021124 | A1 | 11/2007 | |
| DE | 102009037530 | A1 | 2/2011 | |
| EP | 1319599 | A1 | 2/2005 | |
| EP | 1559661 | A2 | 8/2005 | |
| EP | 2019039 | A1 | 1/2009 | |
| ES | 2306583 | A1 * | 11/2008 | |
| ES | 2397415 | T3 | 3/2013 | |
| FR | 2818622 | A1 | 6/2002 | |
| FR | 2956843 | A1 | 1/2016 | |
| JP | 07232791 | A | 9/1995 | |
| JP | 2002104062 | A * | 4/2002 | |
| NL | 1018161 | C1 | 12/2002 | |
| WO | 2000017069 | A1 | 3/2000 | |
| WO | WO-2019056073 | A1 * | 3/2019 | |

OTHER PUBLICATIONS

Machine translation of ES-2306583-A1. (Year: 2008).*
Machine translation of JP-2002104062-A. (Year: 2002).*
Dong (Year: 2021).*
Bothor (Year: 2001).*

* cited by examiner

COLLAPSIBLE, REUSABLE BULK SOLID CONTAINER

TECHNICAL FIELD

The field relates to a bulk solids container for storing, transporting, and discharging the bulk solids. The container can include a flexible, collapsible bag for housing the bulk solids that is supported by a base and two or more rods. When empty, the bag and rods can be collapsible to fit on top of the base whereby the container can be reduced in size and becomes stackable. The container can be reusable.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
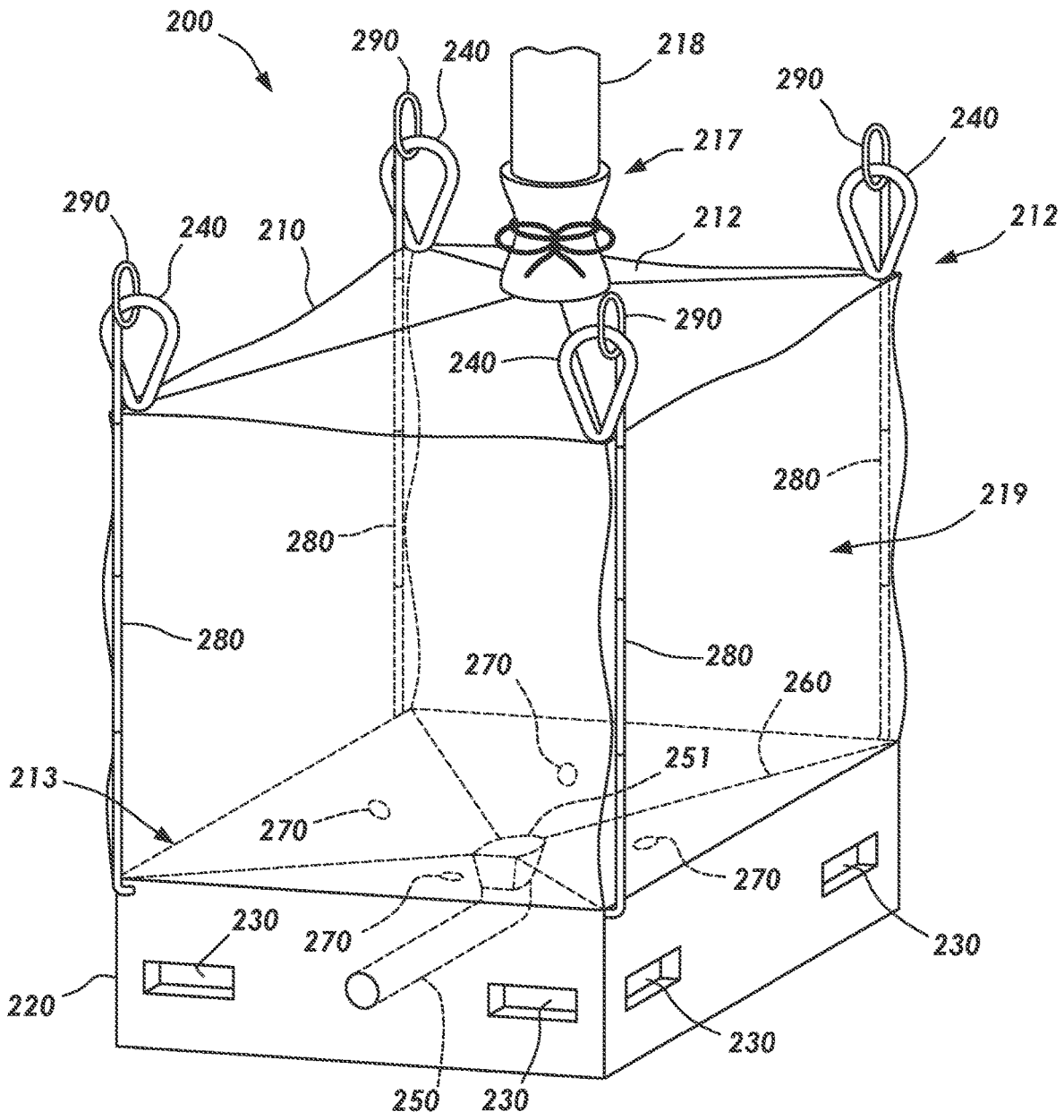
FIG. 1 is a top perspective view of a bulk solid container according to certain embodiments.

There are a variety of industries that store and transport bulk solids. The bulk solids can be additives that are combined with other ingredients to form a mixture including just solids or a fluid mixture. As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. These additives can be in a liquid form or in a solid form.

One example of an industry that uses bulk solid additives is the oil and gas industry. There are a wide variety of fluids used in oil and gas operations that include additives. By way of example, after a wellbore is formed with a drilling fluid, a portion of the wellbore can be cemented. In this manner, controlled production of the reservoir fluid can be accomplished. A cement composition generally includes water, cement, and other additives that can vary depending on the specifics of the subterranean formation. The cement and other additives are typically in a dry, solid form that are then added to water at the wellsite to form the cement composition. Other types of treatment fluids are used in oil and gas operations, for example, drilling fluids, stimulation fluids, and workover fluids that include additives. Other industries besides the oil and gas industry use bulk solids as additives or main ingredients in a variety of blends, fluids, or mixtures.

Oftentimes, the additives are placed in a large receptacle that can measure 35 inches or greater in height, length, and width and can have a total volume on the order of 28 or greater cubic feet. The receptacle can be used to store the additives until it is desirable to prepare the mixture. The receptacle can be transported to a facility or other location whereby the additive can be removed from the receptacle to combine with other ingredients to form the mixture, such as a cement composition or treatment fluid. The large receptacle can house bulk materials, such as bulk liquids or bulk solids. As used herein, the term "bulk material" means a bulk liquid or bulk solid. As used herein, the term "bulk liquid" means a liquid that undergoes commercial transportation in large volumes, for example greater than 0.6 cubic meters ($m^3$). As used herein, the term "bulk solid" means an assembly of solid particles that is large enough (e.g., greater than 0.5 $m^3$) for the statistical mean of any property to be independent of the number of particles. Depending on the density of the bulk material, the large receptacle when filled can weigh between a few hundred kilograms to several tons. Bulk liquids can be stored in a large, flexible sack that allows the liquid to be removed from the sack for adding to other ingredients to form a mixture.

Currently, bulk solids that are oftentimes in the form of a particulate material are stored in flexible bag containers or in rigid containers like silos or drums. A flexible bag container, also known as a Big Bag or super sack, can include heavy-duty handles located near the top of the tote. In order to remove the bulk solid from the bag, machinery, such as a forklift can be used to lift the bag up a sufficient distance off the ground. A worker then walks or crawls underneath the tote to either access an outlet at the bottom of the bag or cut the bag open, whereby the bulk solid can be dispensed from the bag through a hopper into a more rigid container or pneumatic delivery system. Not only does this pose a substantial safety risk for the worker under the considerable weight of the load, but also significant amounts of particulate dust can become airborne that pose a health risk if inhaled. Moreover, the bag can include multiple seams. Another significant disadvantage to bags is that if there is a partial tear in the material or at a seam, then there is a risk that during movement of the tote or even without movement, the force of the bulk solids pushing against the partial tear can create a very large tear or rip the tote and prematurely release the bulk solids. A common occurrence is bags being torn by forklift forks meant to handle the bags or the bags being dragged over abrasive flooring or sharp edges, causing the partial tears. Yet another significant disadvantage to bags is that the bag cannot be reused if the material is cut to release the bulk solids. Yet another disadvantage to bags is that the bulk solids must be transferred to a rigid container, which increases costs and labor and means a facility must have increased square footage in order to store the large rigid containers until use.

Another approach to the storage and transportation of bulk solids is the use of a silo that is made of a solid, rigid material. Silos made of hard plastics or plastic-coated metal can have the disadvantage of creating static electricity when the drum is filled with the bulk solids and when the bulk solids are removed from the drum, affecting the flow behavior of the fluidized bulk solids. Static electricity can create a safety issue and can also prevent all of the bulk solids from being removed from the drum as some amount can cling to the sides of the silo. Silos made of metals or metal alloys are heavier than ones made from hard plastics and are more difficult to move within a facility. Another disadvantage to the use of silos are their dimensions and weight. Due to the large size and weight of the silos, there is no way to efficiently store the silos in a facility because of the increased square footage requirement and the silos cannot be shipped back to a fill facility for re-filling.

Other approaches include using a bladder that is filled with bulk solids and placing the bladder inside a drum. However, because a bladder is generally made from a flexible material and the drum is made from a rigid material, it is very difficult if not impossible to insert the filled bladder inside the drum. This approach does not solve the aforementioned problems of being able to reuse the bladder, the square footage requirements to store the drums, and being able to ship the drums back to a fill facility. Another approach is to place a filled tote or Big Bag into a frame for discharging the bulk solids. However, a vacuum cannot be applied to the bottom of these totes because the bottom and/or sides of the tote can collapse in on itself, which can clog the outlet and prevent or inhibit flow of the bulk solid out of the bottom of the bag. Moreover, the tote must still be lifted to be placed onto a frame, which still poses safety issues. Thus, there is a long-felt need for improved bulk solids containers that solve the problems discussed above.

It has been discovered that a bulk solids container can include a flexible bag that is supported on a base and frame when filled. The bulk solid can be discharged in a safe and healthy manner from a bottom of the bag without the bag collapsing in on itself. The bag and the frame can be collapsed after the bulk solids have been discharged to fit within the base and the entire container can be reused by shipping the container back to a fill facility.

A bulk solids container can include a bag comprising a top and sides configured to house the bulk solid; a base, wherein a bottom portion of the sides of the bag are attached to a perimeter of the base; and two or more rods, wherein the two or more rods are removably attached to an outside of the sides of the bag and permanently or removably connected to the perimeter of the base, wherein the bag and the two or more rods are collapsible to fit on top of the upper surface of the base, and wherein the container is reusable.

It is to be understood that the discussion of any of the embodiments regarding the bulk solids container is intended to apply to all of the apparatus, system, and method embodiments without the need to repeat the various embodiments throughout. Any reference to the unit "gallons" means U.S. gallons.

Turning to the figures, FIG. 1 is a perspective view of a bulk solids container 200. The container 200 can be used to store bulk solids. The bulk solids can be solid particulate that is added to other ingredients to form a mixture. The bulk solid can be an additive. The additive can be used in a treatment fluid. The treatment fluid can be used in an oil and gas operation. The additive can be an additive that is used in a cement composition. The additive can be combined with other ingredients, such as other additives to form an additive package.

The container 200 can include a bag 210. The bag 210 can include a top 212, sides 219, and a bottom portion 213 of the sides. The bag 210 can be configured to receive and house the bulk solid. Although shown in FIG. 1 as being cuboid in shape, it is to be understood that the bag can have other geometric shapes, such as cylindrical or a triangular cross-section. For a cuboid shape, the bag 210 can include four sides 219. A cylindrical shaped bag can include a circular shaped side extending from the top to the bottom of the bag. A bag having a triangular cross-section can include three sides. It is to be understood that as used herein, "side" means the portion of the bag that traverses between the top 212 of the bag to the bottom portion 213 of the sides.

The bag 210 can be made from a flexible material. A flexible material allows the bag 210 to be collapsed when empty. As used herein, the term "empty" means enough of the bulk solid has been removed such that the bag can be collapsed down to fit on top of the upper surface of a base and does not exclude some bulk solids remaining in the bag. Examples of flexible materials include but are not limited to woven fabrics, such as burlap, cotton, linen, canvas, linen, jute, hemp, flax, or blends of different fabrics; and polymer plastics as woven fabrics or non-woven foils. The polymer plastic can be, for example, polyethylene or polypropylene. The fabric can include a coating on the inside of the bag that is used to reduce or prevent static electricity and/or sticking of particles or reduce permeability. The bag 210 can have a thickness. The thickness can be greater than or equal to a thickness that allows the bulk solid to be contained within the bag 210 without rupturing or encountering any other structural deformation or loss of integrity. The thickness can be in a range from 50 to 3,000 micrometers, for example. The bag 210 can have dimensions of a height in the range of 36 to 60 inches and a cross-sectional width in the range of 40 to 48 inches.

The bag 210 can include an opening 217 located at the top 212 of the bag. The opening 217 can be used to fill the bag 210 with the bulk solids. A fill tube 218 can be used for example to fill the bag 210 with the bulk solids. The bag can be partially filled and not filled all the way to the top of the bag or can be completely filled to the top of the bag 210. The opening 217 can include a closure, for example rope, a strap, or zip tie that is closed after the bag is filled so the bulk solid is contained within the bag. Some bulk solids react with water in the air. The bag 210 can further include a desiccant located on an inside of the bag, for example located in a pouch. Another way to prevent reaction of the bulk solid and water in the air can include replacing air inside the bag 210 after filling and closing the opening 217 with an inert gas that displaces the air. According to any of the embodiments, the bag 210 is airtight after the bag is filled and the opening 217 is closed and prior to removing the bulk solids from the bag.

The container 200 also includes a rigid base 220. The base 220 can be made out of a variety of materials. The material for the base 220 can be selected such that the container has sufficient structural integrity to support the weight of the bulk solids. By way of example, the base can be made from metals, metal alloys, hard plastics, structurally reinforced hard plastics, or wood. If the base is made from hard plastics or wood, then one or more areas of the base 220, for example the corners, can be reinforced with a sturdier material such as a metal or metal alloy.

The base 220 can have a variety of dimensions. The base can have a geometric shape that matches the geometric shape of the sides 219 of the bag 210. The base 220 can include an upper surface and sides that extend down from the upper surface. The sides can have a height in the range of 4 to 18 inches. The base 220 can have a perimeter. The perimeter can be greater than or equal to the perimeter of the sides 219 of the bag 210. The base 220 can have a circumference or a width and a depth that are compliant with industry standards for shipping pallets.

As can be seen in FIG. 1, the upper surface of the base 220 can include one or more sloped portions 260 that slope from the sides of the base down towards a discharge opening 251. Accordingly, the sloped portions 260 can funnel the bulk solid to the discharge opening 251 located at the lowest point of the base 220. Some or all of the sloped portions 260 can include a slippery or non-stick coating that aids in the bulk solids being funneled into the discharge opening 251. The coating can be, for example, a high-performance fluoropolymer such as polytetrafluoroethylene under the tradename Teflon™, ceramic, glass, or silicon. Preferably, the coating does not chemically interact with the bulk solids or create a static charge.

Figure 7A:
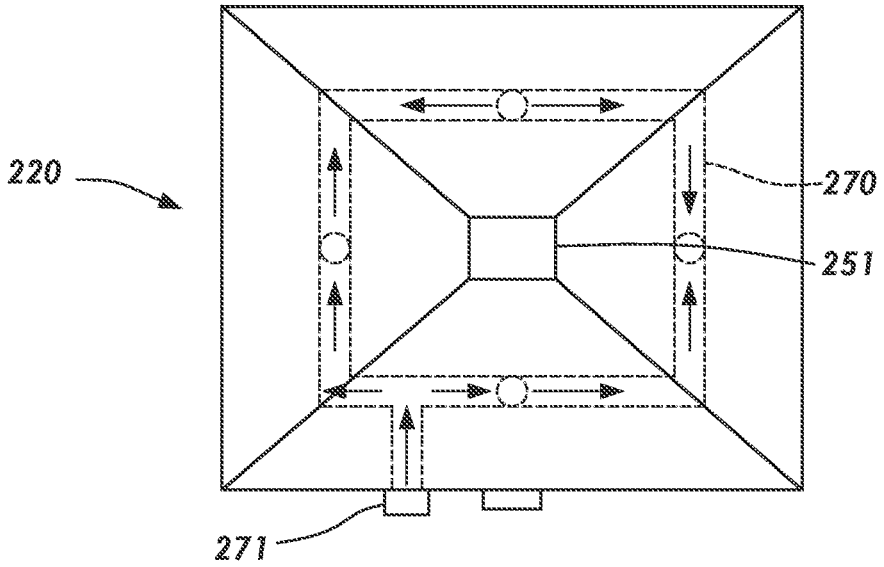
FIG. 7A is a detailed top view of aeration openings in the base according to certain embodiments.
Figure 7B:
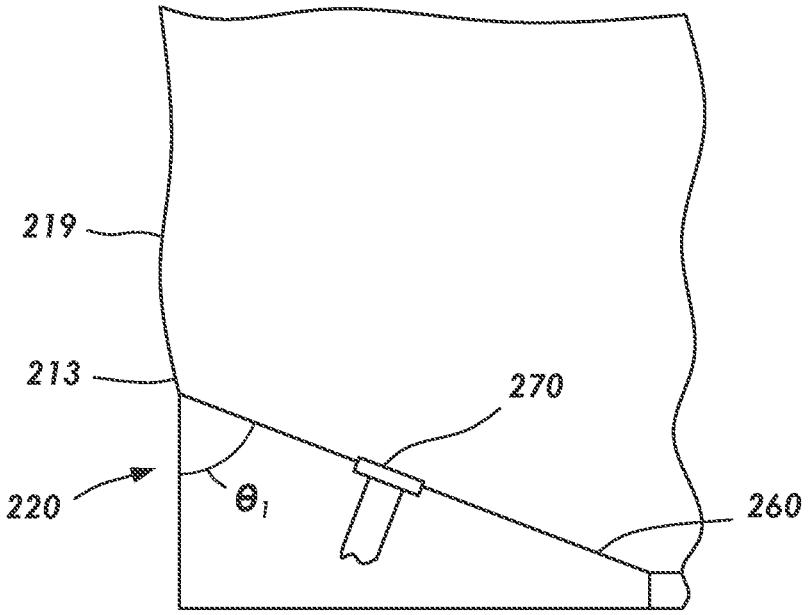
FIG. 7B is a partial side view of aeration openings in the base according to certain embodiments.

The placement of the discharge opening 251 in relation to the height of the sides of the base 220 can vary and can be selected to provide a desired angle $\theta_1$ to the sloped portions 260, for example as shown in FIG. 7B. The angle $\theta_1$ can vary and can be in the range of 5° to 30°. By way of one example, the base 220 can have a square perimeter of 5 feet in width and depth, and sides having a height of 18 inches with the discharge opening 251 being located 10 inches up the sides of the base. According to this example, the sloped portions 260 would have an angle $\theta_1$ of 15°. A screen (not shown) can be included over the top of the discharge opening 251. The screen can have a mesh size such that the bulk solids are able to pass through the screen into the discharge opening 251 but prevents larger, unwanted material from passing through the screen. The screen can be elevated with a top and sides that can be angled over the discharge opening 251 such that the larger material that is screened out stays above or falls to the side of the discharge opening to allow the desired bulk solids to pass through.

According to any of the embodiments, the bag 210 can include a bottom (not shown). All or a portion of the bottom of the bag 210 can lie against the upper surface of the base 220. According to these embodiments, the bottom of the bag 210 is not suspended above the upper surface of the base 220. The bottom of the bag 210 may need to have a larger perimeter than the top 212 or sides of the bag to conform to the sloped portions 260 so the bottom of the bag 210 lies against the upper surface of the base. The sides of the bottom of the bag 210 or the entire bottom of the bag 210 can be secured to the upper surface of the base 220. The portion of the bottom of the bag 210 that is located over the discharge opening 251 can include an opening that allows the bulk solids to be removed from the bag. The opening can match the shape and dimensions of the discharge opening 251. A clamp or other type of fastener can be used to secure the perimeter of the opening on the bottom of the bag to the perimeter of the discharge opening. According to these embodiments, the container 200 can or may not include an aeration opening 270 on the base 220. If aeration openings 270 are included, then the material for the bottom of the bag can be sufficiently permeable to allow air to flow through the aeration openings to aerate the bulk solids.

A discharge line 250 can extend from the discharge opening 251 to an outside of the base 220. When it is desirable to remove some or all of the bulk solid from the bag 210, a vacuum for example can be attached to the discharge line 250 to draw out the bulk solid from the bag. A valve (not shown) can be included to open a flow path through the discharge line 250. When using vacuum to remove the bulk solids, the bulk solids container can further include an air inlet. The air inlet can be placed at the top of the bag or can be aeration channels discussed below. If the air inlet is located at the top of the bag, then an air hose can be inserted into the air inlet to pump air into the bag during removal of the bulk solids. The air entering the bag can be filtered with the use of fabric or other material that keeps particulate from entering the bag. The air inlet can be opened to allow air to enter the bag from the outside such that during removal of the bulk solids under vacuum, the bag is inhibited or prevented from collapsing in on itself.

The container 200 can also include two or more rods 280 that are removably attached to an outside of the sides 219 of the bag 210. For cuboid shaped and triangular cross-section shaped bags, the bag 210 can include three or more corners 211. A cylindrical shaped bag will not have corners but will still have a side. A single rod 280 can be removably attached to each corner 211 of the bag 210 along the sides. For a cylindrical shaped bag, there can be two or more rods 280 that are equally spaced around the circumference of the side. The rods 280 can be made from a rigid material, such as but not excluding metals, metal alloys, hard plastics, that provides vertical structural integrity to the bag 210 when filled. The rods 280 can have a variety of geometric cross-sectional shapes, for example circular, square, or rectangular and can be solid or hollow in their axial direction. The material for the rods 280 can be the same material or a different material than for the base 220. The material for the rods 280 can be selected such that the rods 280 are capable of being permanently or removably attached at one end to the base. The number, location, and spacing of the rods 280 can be selected such that vertical structural integrity is imparted onto the bag 210 both when filled with the bulk solid and when empty. The material for the rods 280 can also be selected such that vertical structural integrity is imparted to the bag 210. Accordingly, vertical structural integrity means the bag 210 does not become substantially deformed or collapse when filled with the bulk solid or when empty. It is to be understood that during the removal of the bulk solid from the bag 210, for example via a vacuum, that the top 212 of the bag 210 may move down along the rods 280 towards the base 220; however the rods 280 can prevent the sides and the top of the bag from collapsing in towards the center of the bag such that they would obstruct the discharge opening; and thus, allows the bulk solids to be efficiently removed. One or more cross-supporting rods (not shown) can extend from a top end of one rod to a top end of another rod, for example, by spanning between the tops of the rods around the outside of the bag.

The rods 280 can have a fixed height or an adjustable height. A top end of the rods 280 can be located adjacent to the top 212 of the bag 210. As shown in FIG. 1, the top end of each rod 280 can include a connector 290, for example like a carabiner hook. The connector 290 can include a mechanism that allows the ring to be opened. The top 212 of the bag 210 can include two or more rings 240 for removably attaching to the connectors 290 on the rods 280. Connectors 290 can be opened such that rings 240 can be inserted into the rod connectors 290 to hold the bag 210 in an upright position and prevent collapse of the bag. The number and spacing of rings 240 can be selected to correspond to the number and spacing of the rods 280. Connectors 290 can be made from the same material as the rods 280. Rings 240 can be made from the same material as the bag 210 or a different material. Preferably, the rings 240 are permanently attached and made of a material that allows permanent attachment to the top 212 of the bag 210. Rings 240 can be made from hard materials such as metals or hard plastics or made from a flexible material such as fabrics or rope.

Figure 2C:
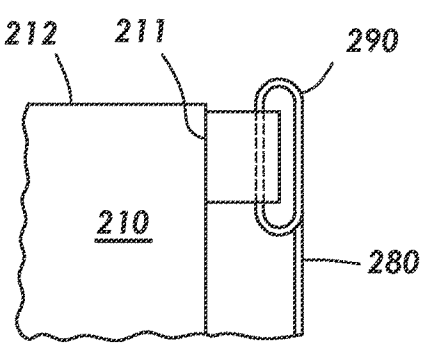
FIGS. 2A-2C are schematics showing releasable attachment of a rod to a perimeter of a bag according to certain embodiments.
Figure 2B:
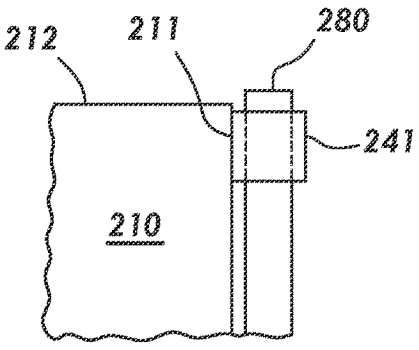
Figure 2A:
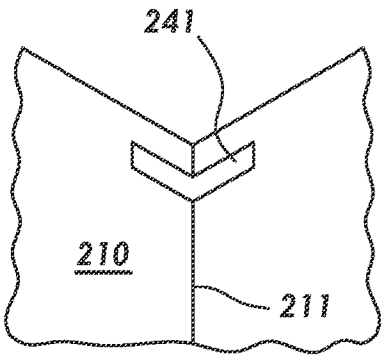

Instead of rings 240 and as shown in FIGS. 2A-2C, a top 212 of the bag 210 can include two or more strips of material 241 attached at each end with an opening between the ends. As shown in FIG. 2A each end of the strips of material 241 can be attached to different sides of the bag with the opening traverse across the corners 211 of the bag 210. The strips of material 241 can be, for example, made of plastic or fabric. As shown in FIG. 2B, a top end of the rods 280 can be inserted into the opening of the strips of material 241 and can extend above the top of the strips of material 241. This can help ensure that the rods 280 do not undesirably become removed from the strips of material 241, for example when filling the bag with the bulk solids. As shown in FIG. 2C, the connectors 290 at the top end of the rods 280 can be removably attached to the strips of material 241.

Figure 4:
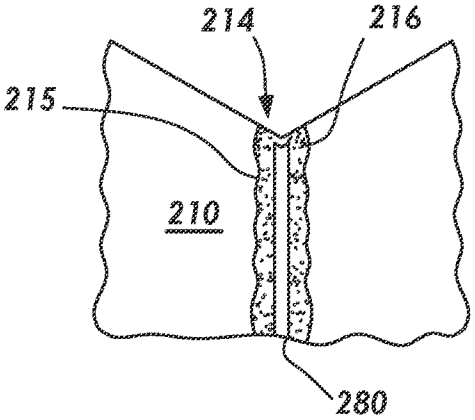
FIG. 4 is a front view of releasable attachment of the rod to a perimeter of the bag according to certain other embodiments.
Figure 3A:
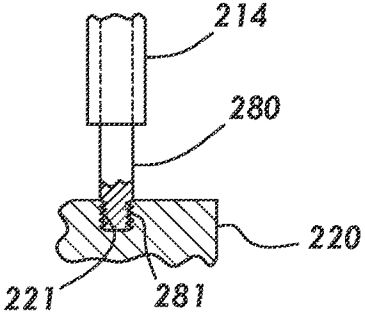
FIG. 3A is an enlarged view of FIG. 3 showing releasable attachment of the rod to a base according to certain embodiments.
Figure 3:
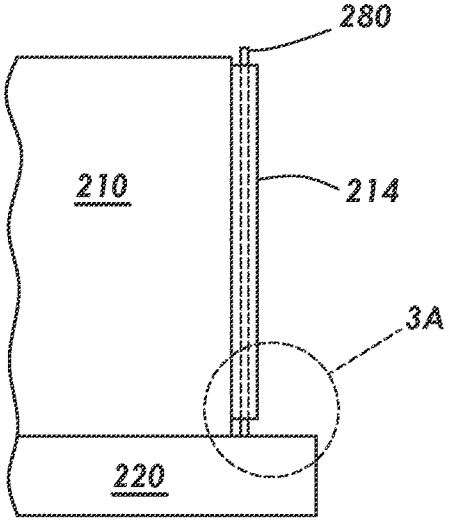
FIG. 3 is a side view of releasable attachment of the rod to a perimeter of the bag according to certain other embodiments.

As shown in FIGS. 3 and 4, an outside of the sides 219 of the bag 210 can include two or more sleeves 214 that extend from an area adjacent to the bottom 213 to an area adjacent to the top 212 of the bag 210. The number and spacing of the sleeves 214 can be selected to correspond to the number and spacing of the rods 280. The sleeves 214 can be located at each of the corners 211 of the bag 210. As shown in FIG. 3, the sleeves 214 can be hollow. In this manner, the rods 280 can be inserted into the sleeves 214 and then removably secured to the base 220. As shown in FIG. 3A, the base 220 can include two or more holes containing male threads 221 at a location that corresponds to the location where the rods 280 are to be attached to the outside of the side of the bag. A lower end of the rods 280 can include a protrusion with female threads 281 that removably attaches the rods 280 to the base 220. The protrusion and the holes can also be reversed whereby the base includes protrusions with female threads that fit within a hole with male threads at the lower end of the rods. In this manner, after each rod 280 is inserted into the sleeves 214, then the rod can be screwed into the base to attach the rods. The holes on the base 220 may not need to include male or female threads, and the lower end of the rods can also exclude threads. According to this embodiment, the lower ends of the rods can include a protrusion that fit snuggly within the holes to removably attach the rods to the base instead of screwing into the base. According to these embodiments, the rods 280 may have a fixed length.

As shown in FIG. 4, the sleeves 214 can be formed by pressing one strip having a plurality of tiny loops 215 to another strip having a plurality of tiny flexible hooks 216 (known by the tradename VELCRO®). Other types of fasteners can be used including without limitation hooks, snap fasteners, and eyes or buttons and loops. Each rod 280 can be placed between the two strips before the strips are pressed or affixed together. According to this embodiment, the rods 280 may have an adjustable length and/or be permanently attached at a lower end to the base 220. The sleeves 214 can also be formed by pressing the two strips together and then inserting the rods 280 into the sleeves 214 similar to the discussion regarding FIG. 3. If the rods 280 are to be inserted into the sleeves 214, then the bag 210 may need to be filled with the bulk solid after the rods are inserted. If the rods 280 are placed between the two strips as discussed with reference to FIG. 4 before the sleeve is formed, then the bag may be filled with the bulk solid before or after the sleeve is formed by pressing the two strips together.

The bag 210 and the rods 280 are collapsible to fit on the top of the upper surface of the base 220 when the bag is empty. As mentioned above, the rods 280 can have a fixed length. According to this embodiment, the rods 280 can include one or more locking hinges (not shown) located along a length of the rods that allow the rods to be collapsed into shorter segments. The hinges can be released such that a segment of the rod can be folded over to shorten the total length of the rod. This can be useful to collapse the rods, so they fit on the top of the base and do not extend past the edges of the base when laid on top of the base. If the height of the rods is less than or equal to a circumference, width, or depth of the base, then hinges may not be needed. Before or after filling the bag with the bulk solid, the segments can be moved away from each other until the hinge locks open. A lower end of the rods 280 can be permanently attached to base 220, for example as shown in FIG. 1. The lower ends of the rods can also include a locking hinge that allows each rod to be folded over to lie parallel to the upper surface of the base after the bag is empty but lock into an upright position when in use.

Figure 6:
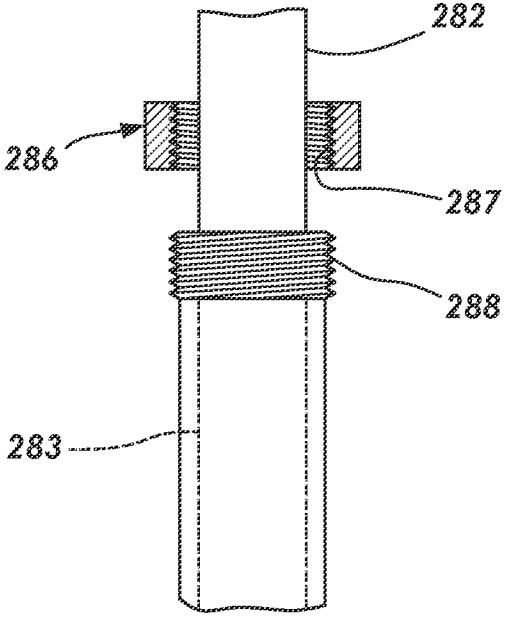
FIG. 6 is a front view of the rod with telescoping portions and a locking mechanism according to certain other embodiments.
Figure 5B:
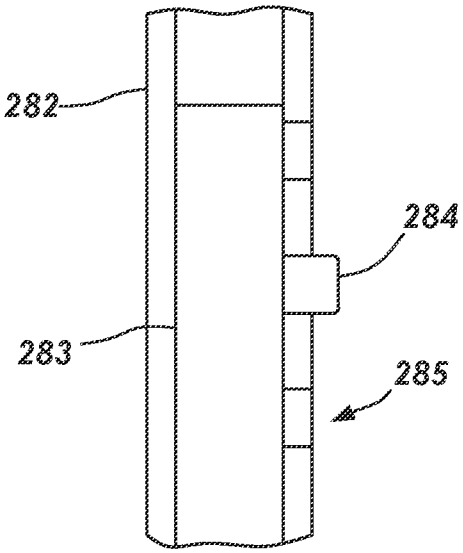
FIGS. 5A and 5B are front and side views, respectively, of the rod with telescoping portions and a locking mechanism according to certain embodiments.
Figure 5A:
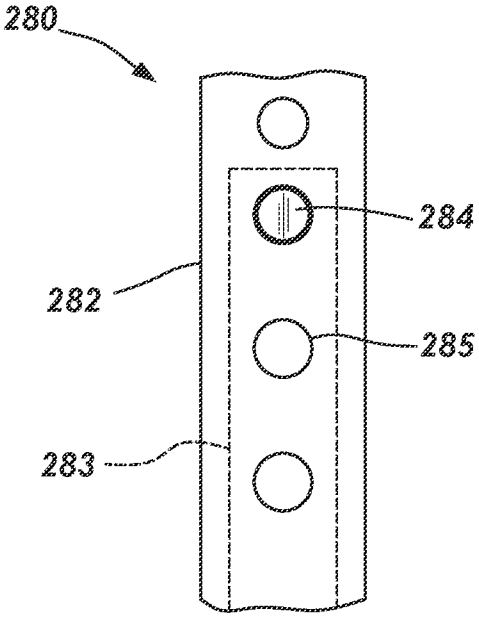

According to other embodiments, the rods 280 have an adjustable length. As shown in FIGS. 5A-6, the rods 280 can be telescoping and include at least a first portion 282 and a second portion 283. There can also be a third, fourth, etc. portions. The first portion 282 and second portion 283 can moved in vertical relation to each other to either decrease or increase the total length of the rods. By way of example, the total length of the rods 280 can be adjusted until the connector 290 at the top of the rod is adjacent to the rings 240 or strips of material 241 at the top 212 of the bag 210. After adjustment, the first portion 282 can be secured to the second portion 283 such that the length does not change until desired. By way of a first example, the first portion 282 can be hollow and include one or more holes 285, and the second portion 283 can include a spring-activated protrusion 284. To adjust the total length of the rod, the protrusion 284 can be depressed and the portions 282/283 moved in relation to each other until the desired total length is achieved, and then the spring-activated protrusion 284 can be activated to protrude through the desired hole 285 to lock the total length.

By way of a second example and as shown in FIG. 6, a nut 286 can be slidingly located around an outside of the first portion 282. The nut 286 can include internal threads 287 around an inner circumference of the nut 286. The second portion 283 can include external threads 288 that can threadingly engage with the internal threads 287. To adjust the total length of the rods 280, the nut 286 is turned counterclockwise in relation to a longitudinal axis of the rod until the first portion 282 slides within the second portion 283. When the total desired length is achieved, then the nut 286 is turned clockwise until the internal threads 287 fully engage with the external threads 288 and pressure from the nut 286 to the first portion 282 prevents the portions 282/283 from moving in relation to each other. The telescoping portions 282/283 can be adjusted to collapse the rods by reduce the total length of the rods 280 when the bag 210 is empty such that the rods 280 can fit on top of the upper surface of the base 220.

As discussed above, the bulk solids can be removed from the bag 210 via the discharge opening 251 and discharge line 250. Not all of the bulk solids need to be removed at one time as it is possible to remove just some of the bulk solids and then wait several hours, days, or weeks for example to remove more of the bulk solids or the remainder of the bulk solid. As discussed above, the upper surface of the base 220 includes sloped portions 260. As shown in FIGS. 1, 7A, and 7B, the upper surface of the base 220 can include one or more aeration openings 270. The aeration openings 270 can be in the form of holes or can be channels whereby air can be pumped through the openings. A hose can be connected to the outside wall of the base 220 via an air inlet 271 to pump air into the aeration openings 270. A check valve or other type of valve (not shown) can prevent the bulk solids from entering the aeration openings 270 if there is a decrease in air pressure being pumped into the aeration openings. The air aerates the bulk solids contained in the bag 210. The aeration, along with the sloped portions 260 can prevent the bulk solids from clogging the discharge opening 251 or discharge line 250 and helps keep the bulk solids flowing through the discharge opening and line during removal of the bulk solids from the bag 210. The air can be pumped into the aeration openings 270 at a variety of pressures, for example in the range of 5 to 15 pounds force per square inch (psi). The aeration openings 270 can include a plurality of pores. The pore size can be less than the particle size of the bulk solids. In this manner, the air can be flowed through the pores but the bulk solids are prevented from falling into the aeration openings 270. According to other embodiments, a mesh screen or a fabric material can be located on top of the aeration openings 270 whereby the air can be flowed through the aeration openings 270 but the bulk solids are prevented from falling into the aeration openings.

Figure 8:
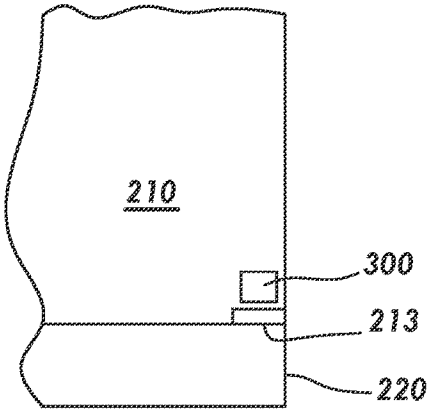
FIG. 8 is a front view showing attachment of a perimeter of the bag to the base according to certain embodiments.

As shown, for example in FIG. 7B, the bottom portion 213 of the sides 219 of the bag 210 are attached around a perimeter of the base 220. The bottom portion 213 of the sides 219 can be permanently attached to the perimeter of the base 220. The bottom portion 213 of the sides 219 can be attached to the base 220 around the perimeter using an adhesive, for example glue or double-sided tape. According to another example and as shown in FIG. 8 for a wooden base, the bottom portion 213 of the sides 219 can be placed onto the top surface of the perimeter of the base 220 and then a strip of base material 300 (e.g., a strip of wood) having a length slightly less than or equal to the length of the sides 219 of the bag can be inserted inside the bag through the opening 217 and laid along the perimeter of the bottom portion 213 of the sides 219 and base. The strip of base material 300 can then be secured to the top of the base 220 through the bag material for example using screws, nails, or another attachment mechanism. Securing the sides 219 of the bag 210 to the perimeter of the base 220 provides a completely closed container except for the opening at the top of the bag for storage and removal of the bulk solids.

According to other embodiments, the bottom portion 213 of the sides 219 can be removably attached to the perimeter of the base 220. Fasteners, such as but not limited to, nuts and bolts, hooks and eyes, buttons and loops, or snap fasteners can be used to secure the bag to the base. Being able to detach the bag from the base can be helpful if the bag is damaged or needs to be replaced with another bag that is then attached to the same base.

Figure 9:
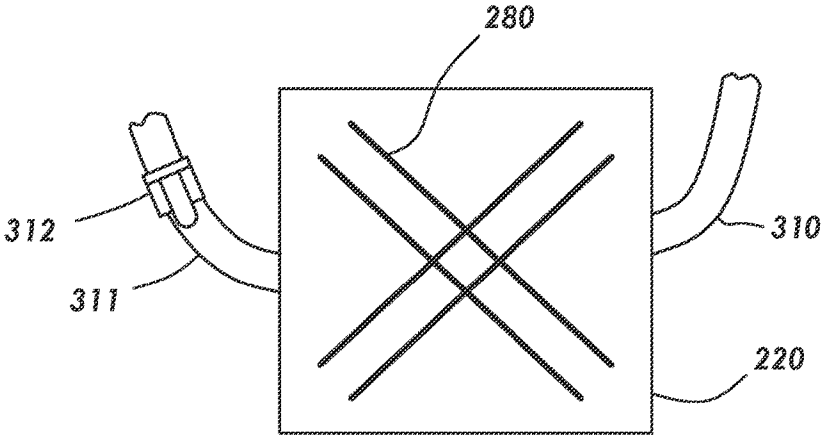
FIG. 9 is a top view showing the bag and the rods collapsed on top of the base and a tie down strap for securing the bag and the rods to the top of the base according to certain embodiments.

One of the many unique advantages of the container 200 is the bag 210 and the rods 280 are collapsible to fit on top of the upper surface of the base 220 when the bag is empty. Because the bag 210 is made from a flexible material, it can be folded or squeezed down to fit within the base. The rods 280 can also be collapsed (i.e., converted from an upright orientation that is approximately 90° with respect to the upper surface of the base to a horizontal orientation) by unscrewing or removing the rods from the base and laying the rods on top of the base, for example as shown in FIG. 9 or releasing the hinges and laying the rods down onto the top of the base. As also shown in FIG. 9, a tie down strap including a first strap 310 and a second strap 311 can be used to secure the bag and the rods to the top of the base. The tie down strap can also include a mechanism 312, such as a ratcheting mechanism, that takes up any slack so the straps 310/311 are taut across the top of the base 220. This can be useful to prevent the bag and/or the rods from protruding beyond an edge of the base or falling off the base during movement of the container 200. A cover (not shown) can also be positioned over the base after the bag and rods have been collapsed.

Another unique advantage is the container 200 can be reusable. After the bag is emptied of the bulk solids and collapsed, the container can be shipped back to a fill facility whereby the bag can be re-filled with the same or different bulk solid. As shown in FIG. 1, the base 220 can include pairs of forklift pockets 230 that can receive forks of a forklift for moving the container 200, either filled with the bulk solids or empty, around a facility or to place the container on a shipping vessel or truck for shipment back to a fill facility. If the bag is to be re-filled with a different bulk solid, then the inside of the bag may need to be cleaned so there is no cross-contamination of solids. Removably attaching the bag to the base can be helpful in order to detach the bag from the base for cleaning and then re-attaching the same bag or a different bag to the base. Not only does reusing the container 200 save money, but it also saves on the amount of raw products that are used to manufacture totes, Big Bags, and silos.

Another unique advantage is that emptying of the bag does not require the bag to be lifted up in order for a worker to crawl underneath the bag to cut the bag or attach a hose to an outlet to remove the bulk solids. This prevents the safety issues that are common to current bulk solid totes or bags. Moreover, health and environmental concerns are prevented because no dust is released into the air during removal of the bulk solids as is the case with current totes or bags.

Yet another unique advantage is multiple empty containers 200 with the bags and rods collapsed as described above can be stacked on top of each other. Stacking of the containers 200 can reduce the total square footage needed for storing the empty containers or shipping the empty containers back to a fill facility. Once stacked, the containers 200 can be secured together via a variety of ways as shown in FIGS. 10-14.

Figure 10A:
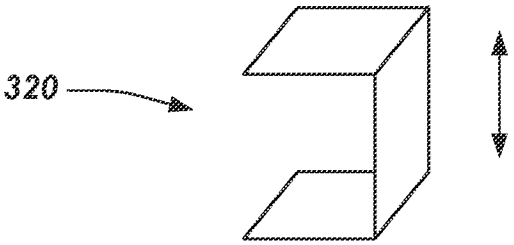
FIGS. 10A and 10B are a front view of a clamp and multiple bases being stacked on top of each other and secured to each other with clamps according to certain embodiments.
Figure 10B:
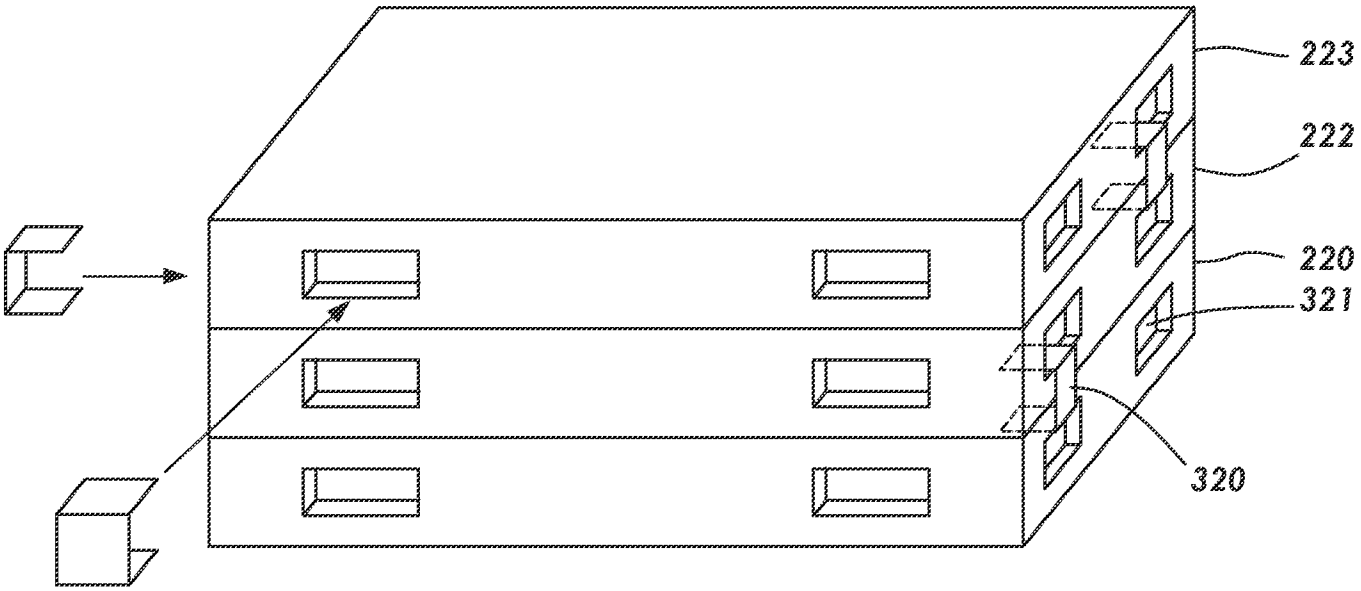

FIG. 10 shows a third base 223 stacked on top of a second base 222 that is stacked on top of the base 220. Although shown in the drawings as only the bases of three containers being stacked on top of each other, it is to be understood that only two bases can be stacked or more than three can be stacked. Two or more sides of the bases 220/222/223 can include at least one opening 321 that traverses through the sides of the bases 220/222/223. A clamp 320 can be inserted into the opening 321 of the base 220 and the opening 321 of the second base 222, and another clamp 320 can be inserted into the opening 321 of the second base 222 and the opening 321 of the third base 223. As shown, there can be clamps 320 used on one side of the bases 220/222/223 and other clamps 320 used on an opposite side of the bases. There can also be clamps used on every side of the bases 220/222/223. After insertion into the openings 321, the clamps 320 can be tightened to secure the bases to each other.

Figure 11:
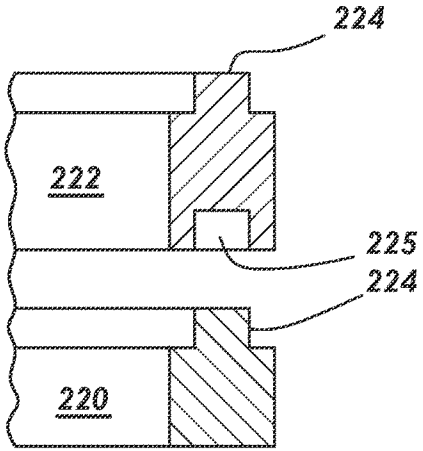
FIG. 11 is a front view of multiple bases being stacked on top of each other and secured to each other according to certain other embodiments.

Turning to FIG. 11, the upper edges of the base 220 can include a tongue 224. An underneath edge of the second base 222 can include a groove 225 and a tongue 224. Although not shown, the base 220 can also include a groove 225. When the bases are stacked together, the tongues 224 fit within the grooves 225 of the base stacked on top. When the tongues are positioned within the grooves, then the bases are inhibited or prevented from sliding off each other.

Figure 12:
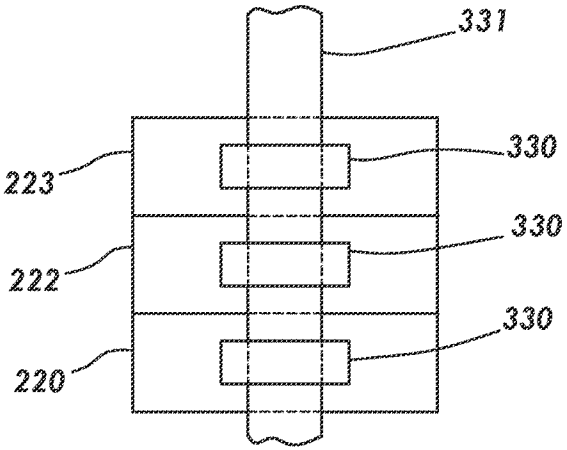
FIG. 12 is a side view of multiple bases being stacked on top of each other and secured to each other according to certain other embodiments.

Turning to FIG. 12, a loop 330 being attached at each end and having an opening through the middle can be attached to a side of the bases 220/222/223. Preferably, the loops 330 are aligned with one another. A single strap 331 can be inserted through each of the loops 330 that are aligned. An opposite side of the bases 220/222/223 can also include a loop 330. The single strap 331 or another strap can be inserted through the loops on the opposite side. A ratcheting mechanism (not shown) can be used to pull the single strap 331 taut along the sides of the bases 220/222/223. The ratcheting mechanism can also be used to connect the single strap and another strap on the opposite side together and then pulled taut across the sides of the bases 220/222/223.

Figure 13A:
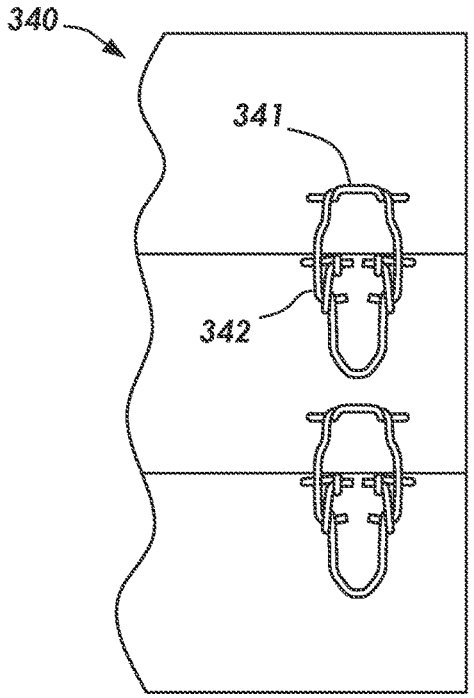
FIGS. 13A and 13B are front and side views, respectively, of multiple bases being stacked on top of each other and secured to each other according to certain other embodiments.
Figure 13B:
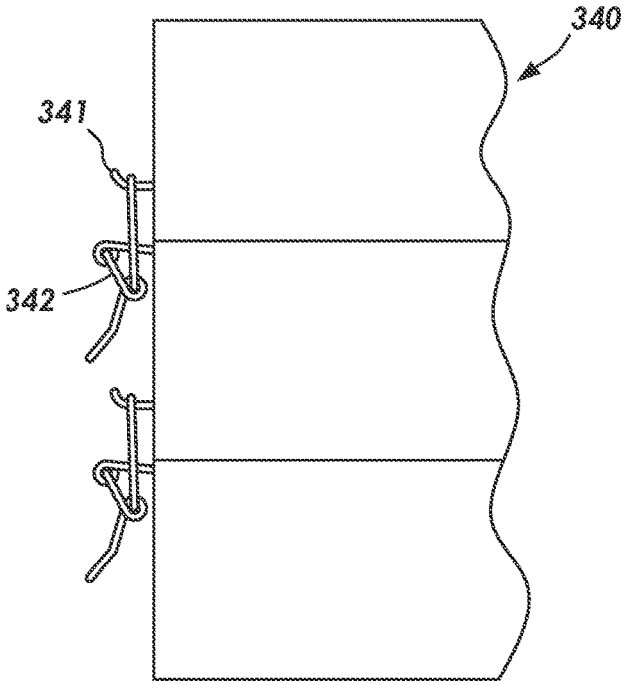

As shown in FIGS. 13A and 13B, a clamp lock 340 can also be used to secure the bases 220/222/223 to each other. The clamp lock 340 can include a D-ring 341 and a hinged clamp 342 whereby an upper part of the hinged clamp 342 can be placed over the D-ring 341 and then tightened by moving the lower part of the hinged clamp 342 down until it locks. A D-ring 341 can be located on a side of the second base 222 and third base 223 and a hinged clamp 342 can be located on a side of the base 220 and the second base 222. The bases 220/222/223 can be secured together after stacking by placing the upper part of the hinged clamp 342 on the base below over the D-ring 341 on the base above and then tightening them together by moving the lower part of the hinged clamp 342 down until it locks. The location of the D-ring 341 and the hinged clamp 342 can also be reversed such that the base underneath has the D-ring 341 and the base above has the hinged clamp 342. According to this embodiment, the clamp is tightened by moving the lower part of the hinged clamp up until it locks.

Figure 14:
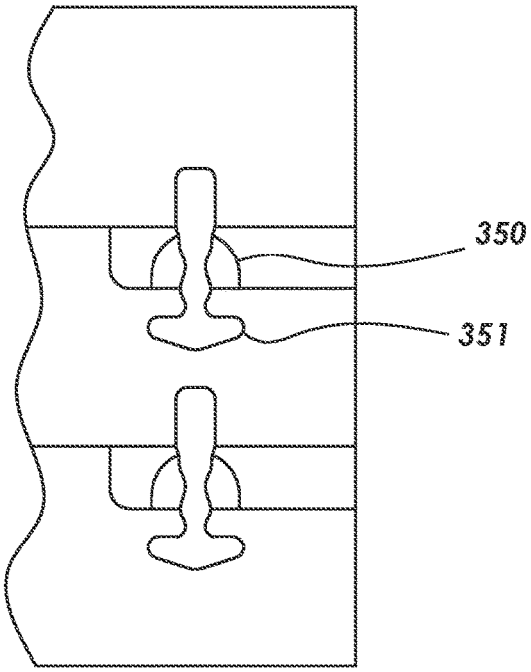
FIG. 14 is a front view of multiple bases being stacked on top of each other and secured to each other according to certain other embodiments.

As shown in FIG. 14, a side of the base 220 can include a grooved protrusion 350 and a side of the second base 222 can include a latch 351; and a side of the second base 222 can include a grooved protrusion 350 and a side of the third base 223 can include a latch 351. The latch 351 can be made from a rubber material. The grooved protrusion 350 can be shaped and have dimensions to receive a portion of the latch 351. The latch 351 can have a handle located at the bottom of the latch. In this manner, the portion of the latch 351 can be inserted into the grooved protrusion 350 by pulling out and down on the handle until the portion of the latch fits snuggly within the grooved protrusion. When the portion of the latch 351 is located within the grooved protrusion 350, then the bases 220/222/223 are secured to each other.

Methods of using the container 200 can include any or all of the following: attaching the rods to the base or extending the rods to a vertical orientation on the base; attaching the rods to the outside of the bag; adjusting the height of the rods; filling the bag with a bulk solid via the opening at the top of the bag and then closing the opening; transporting the filled container to a removal facility; storing the filled container; removing all or a portion of the bulk solids from the bag; pumping air into the aeration chambers during removal of the bulk solids; detaching the rods from the outside of the side of the bag; collapsing the bag onto the upper surface of the base; collapsing the rods and/or laying the rods on top of the collapsed bag; moving the base to another location at the removal facility; stacking more than one container base holding the collapsed bag and rods on top of another container base holding another collapsed bag and rods; securing the stacked bases to each other; and transporting the container or stack of containers to a filling facility to be reused.

An embodiment of the present disclosure is a bulk solids container comprising: a bag comprising a top and sides configured to house the bulk solid; a rigid base, wherein a bottom portion of the sides of the bag are connected to a perimeter of the base; and two or more rods, wherein the two or more rods are removably attached to an outside of the sides of the bag and permanently or removably connected to the perimeter of the base, wherein the bag and the two or more rods are collapsible to fit on top of an upper surface of the base when the bag is empty, and wherein the container is reusable. Optionally, the bag has a cross-sectional shape selected from square, rectangular, circular, oval, or triangular. Optionally, the bag is made from a flexible material selected from burlap, cotton, linen, canvas, linen, jute, hemp, flax, blends thereof, polyethylene, or polypropylene. Optionally, the bag further comprises an opening located at the top of the bag, wherein the opening is configured to allow the container to be filled with the bulk solid. Optionally, the base is made from a material selected from the group consisting of metals, metal alloys, hard plastics, structurally reinforced hard plastics, wood, and combinations thereof. Optionally, the base comprises an upper surface and sides that extend down from the upper surface. Optionally, the upper surface of the base comprises one or more sloped portions that slope from the sides of the base down towards a discharge opening. Optionally, the container further comprises a discharge line extending from the discharge opening to an outside of the base. Optionally, a top end of the two or more rods comprises a connector, wherein the top of the bag comprises two or more rings, and wherein the two or more rods are removably attached to the outside of the sides of the bag via connecting the connectors to rings. Optionally, the top of the bag comprises two or more strips of material attached at each end to the outside of the sides of the bag with an opening located between the ends, and wherein the two or more strips of material are configured to receive a top end of the two or more rods into the opening. Optionally, the outside of the sides of the bag comprises two or more hollow sleeves that extend from an area adjacent to the bottom portion of the sides to an area adjacent to the top of the bag, wherein each of the two or more sleeves are configured to receive one of the two or more rods. Optionally, the two or more hollow sleeves are formed by pressing a first strip having a plurality of tiny loops to a second strip having a plurality of tiny flexible hooks together, or via hooks and eyes, buttons and loops, or snap fasteners. Optionally, the base further comprises two or more holes located on top of the perimeter of the base, wherein the two or more rods comprise a protrusion extending from a bottom end of the rods, and wherein the two or more rods are removably connected to the base via insertion of the protrusions into the holes. Optionally, the protrusions include female threads, and wherein the holes include corresponding male threads. Optionally, the two or more rods are permanently connected to the perimeter of the base, wherein a bottom end of the two or more rods comprises a locking hinge located adjacent to the perimeter of the base, and wherein the locking hinge is configured to allow the two or more rods to be collapsed to lie parallel to the upper surface of the base. Optionally, the two or more rods have a fixed length, and wherein the two or more rods comprise one or more locking hinges located along a length of the rods that allow the rods to be collapsed into shorter segments. Optionally, the two or more rods have an adjustable length, wherein the two or more rods comprise a first telescoping portion and a second telescoping portion, and wherein the first and second telescoping portions are configured to move in vertical relation to each other to either decrease or increase the total length of the rods. Optionally, the upper surface of the base comprises one or more aeration openings configured to receive air from an air inlet and aerate the bulk solids. Optionally, the container is stackable onto a second container when the container and the second container are empty and when the two or more rods and the bag of the container and the second container have been collapsed. Optionally, the container and the second container are securable to each other after stacking.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more containers, rods, bases, etc., as the case may be, and does not indicate any sequence. Furthermore, it is to be understood that the mere use of the word "first" does not require that there be any "second," and the mere use of the word "second" does not require that there be any "third," etc. As used herein, the terms top, bottom, upper, and lower are for illustrative purposes only wherein top and upper are located closer to the top of the bag or base, and wherein bottom and lower are located closer to the bottom of bag or base.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A bulk solids container comprising:

a bag comprising a top and sides configured to house the bulk solid, wherein the sides of the bag have a height that spans from a top of the sides to a bottom of the sides;

a rigid base, wherein the bottom of the sides of the bag are connected entirely around a perimeter of the base; and two or more rods, wherein the two or more rods are removably attached to an outside of the sides of the bag and permanently or removably connected to the perimeter of the base, and wherein at least a top portion of the two or more rods are not horizontally directly or indirectly connected to each other, wherein the bag and the two or more rods are collapsible to fit on top of an upper surface of the base when the bag is empty, and wherein the container is reusable.

2. The bulk solids container according to claim 1, wherein the bag has a cross-sectional shape selected from square, rectangular, circular, oval, or triangular.

3. The bulk solids container according to claim 1, wherein the bag is made from a flexible material selected from burlap, cotton, linen, canvas, linen, jute, hemp, flax, blends thereof, polyethylene, or polypropylene.

4. The bulk solids container according to claim 1, wherein the bag further comprises an opening located at the top of the bag, wherein the opening is configured to allow the container to be filled with the bulk solid.

5. The bulk solids container according to claim 1, wherein the base is made from a material selected from the group consisting of metals, metal alloys, hard plastics, structurally reinforced hard plastics, wood, and combinations thereof.

6. The bulk solids container according to claim 1, wherein the base comprises an upper surface and sides that extend down from the upper surface.

7. The bulk solids container according to claim 6, wherein the upper surface of the base comprises one or more sloped portions that slope from the sides of the base down towards a discharge opening.

8. The bulk solids container according to claim 7, further comprising a discharge line extending from the discharge opening to an outside of the base.

9. The bulk solids container according to claim 1, wherein a top end of the two or more rods comprises a connector, wherein the top of the sides of the bag comprises two or more rings, and wherein the two or more rods are removably attached to the outside of the top of the sides of the bag via connecting the connectors to rings.

10. The bulk solids container according to claim 1, wherein the top of the sides of the bag comprises two or more strips of material attached at each end to the outside of the sides of the bag with an opening located between the ends, and wherein the two or more strips of material are configured to receive a top end of the two or more rods into the opening.

11. The bulk solids container according to claim 1, wherein the outside of the sides of the bag comprises two or more hollow sleeves that extend from an area adjacent to the bottom of the sides to an area adjacent to the top of the sides of the bag, wherein each of the two or more sleeves are configured to receive one of the two or more rods.

12. The bulk solids container according to claim 11, wherein the two or more hollow sleeves are formed by pressing a first strip having a plurality of tiny loops to a second strip having a plurality of tiny flexible hooks together, or via hooks and eyes, buttons and loops, or snap fasteners.

13. The bulk solids container according to claim 1, wherein the base further comprises two or more holes located on top of the perimeter of the base, wherein the two or more rods comprise a protrusion extending from a bottom end of the rods, and wherein the two or more rods are removably connected to the base via insertion of the protrusions into the holes.

14. The bulk solids container according to claim 13, wherein the protrusions include female threads, and wherein the holes include corresponding male threads.

15. The bulk solids container according to claim 1, wherein the two or more rods are permanently connected to the perimeter of the base, wherein a bottom end of the two or more rods comprises a locking hinge located adjacent to the perimeter of the base, and wherein the locking hinge is configured to allow the two or more rods to be collapsed to lie parallel to the upper surface of the base.

16. The bulk solids container according to claim 1, wherein the two or more rods have a fixed length, and wherein the two or more rods comprise one or more locking hinges located along a length of the rods that allow the rods to be collapsed into shorter segments.

17. The bulk solids container according to claim 1, wherein the two or more rods have an adjustable length, wherein the two or more rods comprise a first telescoping portion and a second telescoping portion, and wherein the first and second telescoping portions are configured to move in vertical relation to each other to either decrease or increase the total length of the rods.

18. The bulk solids container according to claim 1, wherein the upper surface of the base comprises one or more aeration openings configured to receive air from an air inlet and aerate the bulk solids during removal of the bulk solids from the bag.

19. The bulk solids container according to claim 1, wherein the container is stackable onto a second container when the container and the second container are empty and when the two or more rods and the bag of the container and the second container have been collapsed.

20. The bulk solids container according to claim 19, wherein the container and the second container are securable to each other after stacking.

* * * * *